US012545541B2

(12) United States Patent
Nishimura et al.

(10) Patent No.: US 12,545,541 B2
(45) Date of Patent: Feb. 10, 2026

(54) SHEET POST-PROCESSING DEVICE AND IMAGE FORMING SYSTEM

(71) Applicant: KYOCERA Document Solutions Inc., Osaka (JP)

(72) Inventors: Takuya Nishimura, Osaka (JP); Seiichi Shirasaki, Osaka (JP); Yasunori Ueno, Osaka (JP); Takehiko Okada, Osaka (JP); Keisuke Egawa, Osaka (JP); Yusuke Takano, Osaka (JP); Terumitsu Noso, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 198 days.

(21) Appl. No.: 18/415,724

(22) Filed: Jan. 18, 2024

(65) Prior Publication Data

US 2024/0246785 A1 Jul. 25, 2024

(30) Foreign Application Priority Data

Jan. 25, 2023 (JP) ..... 2023-009238

(51) Int. Cl.
*B65H 31/34* (2006.01)
*B65H 9/10* (2006.01)
*B65H 39/10* (2006.01)

(52) U.S. Cl.
CPC ..... *B65H 9/101* (2013.01); *B65H 39/10* (2013.01); *B65H 2301/4222* (2013.01); *B65H 2801/27* (2013.01)

(58) Field of Classification Search
CPC ..... B65H 9/10; B65H 9/101; B65H 31/34; B65H 39/10; B65H 2301/4222; B65H 2801/27; B65H 2404/70; B65H 2301/3613; B65H 2301/363; B65H 2301/3611; B65H 2301/36112
USPC ..... 270/58.07, 58.08
See application file for complete search history.

(56) References Cited

U.S. PATENT DOCUMENTS

| | | | | |
|---|---|---|---|---|
| 8,899,569 | B2 * | 12/2014 | Soga | B65H 9/10 270/58.11 |
| 10,351,383 | B2 * | 7/2019 | Saito | B65H 31/36 |
| 11,249,432 | B2 * | 2/2022 | Komiyama | B65H 31/10 |
| 11,427,428 | B2 * | 8/2022 | Furumido | B65H 33/08 |
| 11,577,926 | B2 * | 2/2023 | Furumido | B65H 31/34 |
| 2012/0025442 | A1 * | 2/2012 | Naraoka | B65H 33/08 270/58.27 |
| 2021/0101771 | A1 * | 4/2021 | Furumido | B65H 31/3036 |

FOREIGN PATENT DOCUMENTS

JP 2014-151980 A 8/2014

* cited by examiner

*Primary Examiner* — Leslie A Nicholson, III
(74) *Attorney, Agent, or Firm* — Stein IP, LLC

(57) ABSTRACT

When performing an alignment process on a sheet loaded on the processing tray in a state where a front end of the sheet is protruded from a discharge outlet above a discharge tray, the control unit performs a front end alignment process in which a pair of discharge tray cursors sandwich the front end of the sheet protruded above the discharge tray in the width direction, and a rear end alignment process in which the pair of processing tray cursors sandwich a rear end of the sheet on the processing tray in the width direction.

8 Claims, 15 Drawing Sheets

(front end alignment process)

(rear end alignment process)

(when loading onto processing tray)

(front end alignment process)

(rear end alignment process)

SHEET POST-PROCESSING DEVICE AND IMAGE FORMING SYSTEM

INCORPORATION BY REFERENCE

This application is based upon and claims the benefit of priority from the corresponding Japanese Patent Application No. 2023-009238 filed Jan. 25, 2023, the entire contents of which are hereby incorporated by reference.

BACKGROUND

The present disclosure relates to a sheet post-processing device and an image forming system.

Conventionally, there is known a sheet post-processing device that performs a stapling process or the like on sheets. The conventional sheet post-processing device is equipped with a processing tray. The processing tray loads the sheets on which the stapling process is performed. After the stapling process, the sheets are discharged from the processing tray to a stack tray.

SUMMARY

A sheet post-processing device according to a first aspect of the present disclosure includes a processing tray, a post-processing section, a discharge outlet, a discharge tray, a discharging member, a pair of processing tray cursors, a pair of discharge tray cursors, and a control unit. The processing tray is a tray on which a sheet is loaded. The post-processing section performs predetermined post-processing on the sheet. The discharge outlet is an outlet through which the sheet on the processing tray is discharged. The discharge tray is a tray on which the sheet discharged through the discharge outlet is loaded. The discharging member conveys the sheet on the processing tray toward the discharge outlet and discharges the sheet onto the discharge tray through the discharge outlet. The pair of processing tray cursors are movable above the processing tray in a reciprocation manner in a width direction perpendicular to a sheet conveying direction, and sandwich the sheet in the width direction so as to align the sheet. The pair of discharge tray cursors are movable above the discharge tray in a reciprocation manner in the width direction, and sandwich the sheet in the width direction so as to align the sheet. When performing an alignment process on the sheet loaded on the processing tray, in a state where a front end of the sheet is protruded from the discharge outlet onto the discharge tray, the control unit performs a front end alignment process in which the pair of discharge tray cursors sandwich the front end of the sheet protruded above the discharge tray in the width direction, and a rear end alignment process in which the pair of processing tray cursors sandwich a rear end of the sheet on the processing tray in the width direction.

An image forming system according to a second aspect of the present disclosure includes the sheet post-processing device described above and an image forming apparatus. The image forming apparatus forms an image on a sheet. The sheet post-processing device performs predetermined post-processing on the sheet after image formation.

DETAILED DESCRIPTION

<Outline of Image Forming System>

Figure 1:
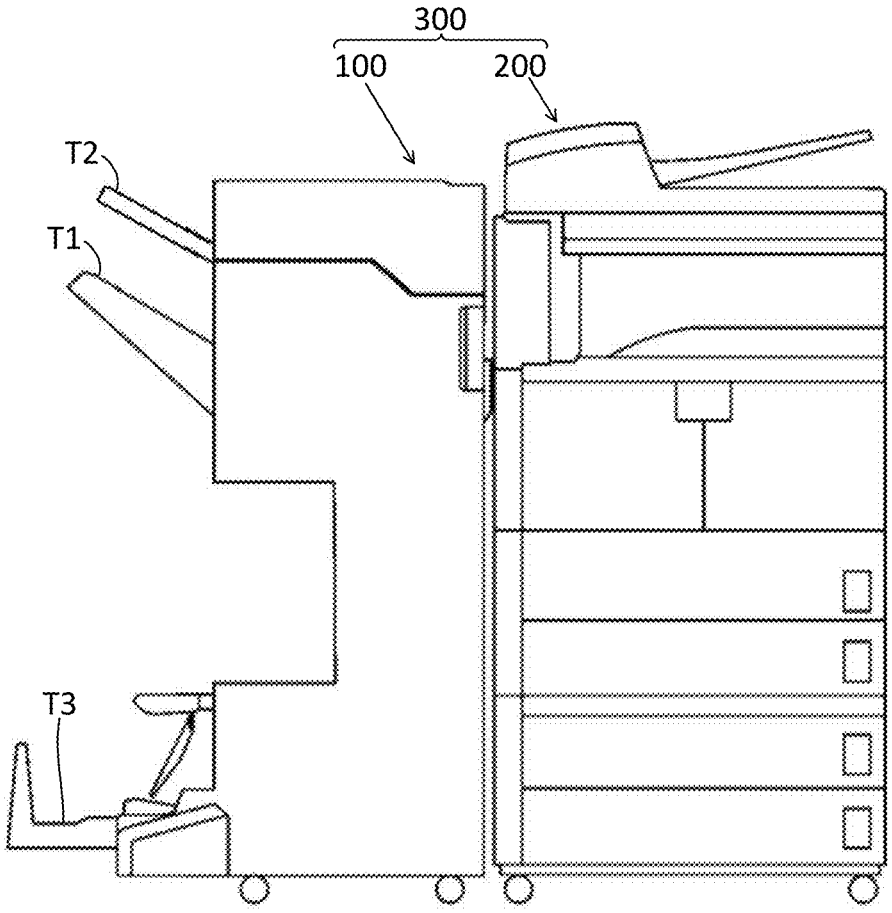
FIG. 1 is an overall view of an image forming system according to one embodiment.

A sheet post-processing device 100 of this embodiment is connected to an image forming apparatus 200 as illustrated in FIG. 1. The sheet post-processing device 100 and the image forming apparatus 200 constitute an image forming system 300. In other words, the image forming system 300 includes the sheet post-processing device 100 and the image forming apparatus 200.

The image forming apparatus 200 prints an image on a sheet S. A type of the sheet S is not particularly limited. For instance, a paper sheet is used as the sheet S. The sheet post-processing device 100 performs post-processing on the sheet S after printing.

The image forming apparatus 200 includes an image forming section (not shown). For instance, the image forming apparatus 200 is an inkjet recording apparatus. In other words, the image forming section includes a recording head that ejects ink. The image forming section ejects ink onto the sheet S so as to form an image. Note that a printing method of the image forming section is not particularly limited, and it may be an electrophotographic method.

The image forming apparatus 200 conveys the sheet S and forms an image on the sheet S. In addition, the image forming apparatus 200 conveys the sheet S after printing and feeds the sheet S to the sheet post-processing device 100.

The sheet post-processing device 100 receives the sheet S from the image forming apparatus 200. The sheet post-processing device 100 conveys the sheet S, and performs post-processing such as a punching process, a folding process, a stapling process, or a booklet process on the sheets S. After the post-processing, the sheet post-processing device 100 discharges the sheets S.

Note that the sheet post-processing device 100 is attachable and detachable from the image forming apparatus 200. The sheet post-processing device 100 may be solely usable. In this case, the sheet post-processing device 100 includes a setting tray on which the sheets S are set. Further, the sheet post-processing device 100 carries in the sheets S set on the setting tray and performs the post-processing on the sheets S.

In the following description, the direction perpendicular to an installation surface of the sheet post-processing device 100 (e.g., a flat floor) is defined as the up and down direction.

<Structure of Sheet Post-Processing Device>

Figure 2:
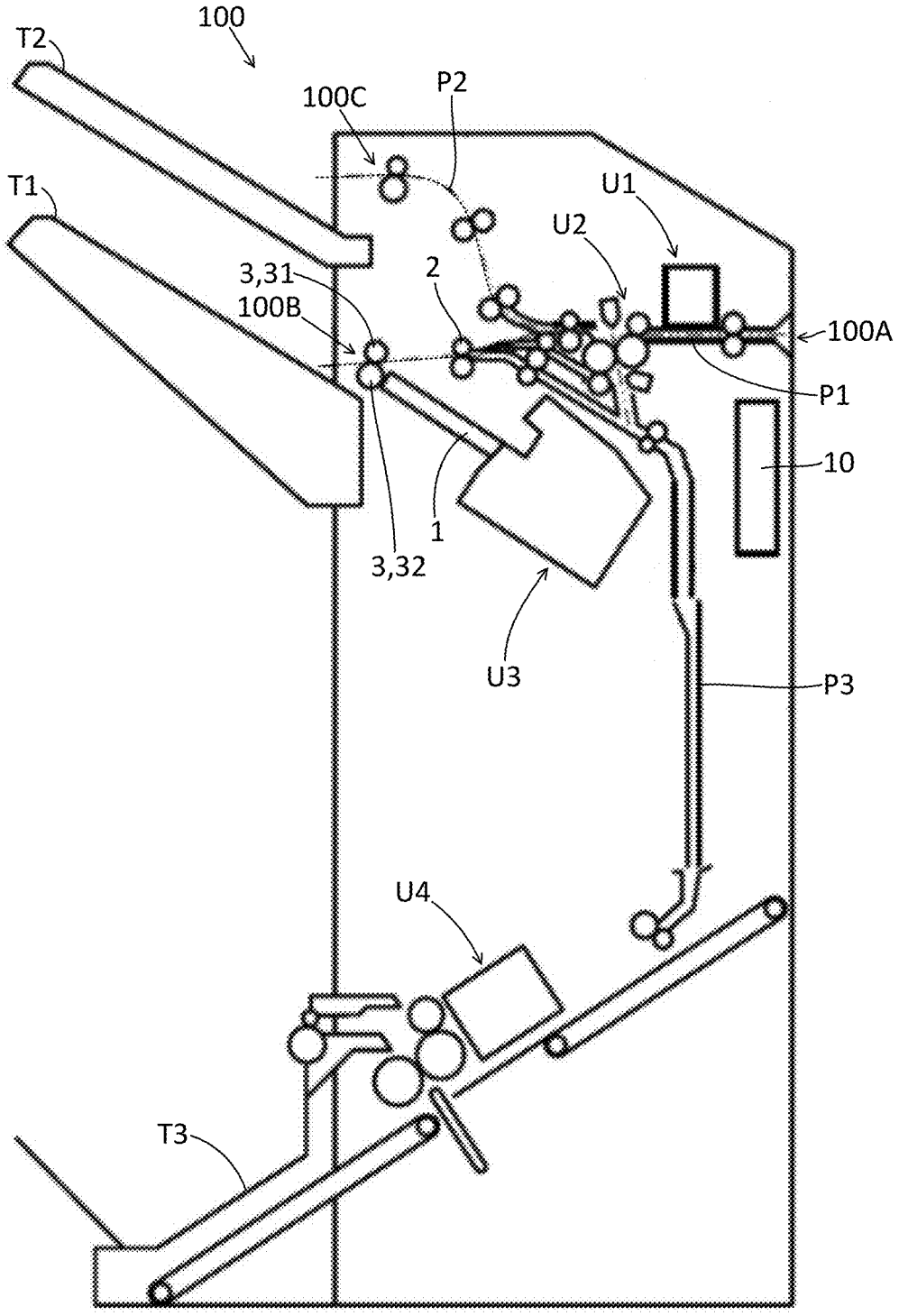
FIG. 2 is a schematic view of a sheet post-processing device according to one embodiment.

The sheet post-processing device 100 has a structure illustrated in FIG. 2. Note that FIG. 2 is a schematic view of the sheet post-processing device 100 viewed from the front. In the following description, "left" and "right" mean directions when the sheet post-processing device 100 is viewed from the front.

The sheet post-processing device 100 includes a carry-in entrance 100A of the sheet S, a main discharge outlet 100B, and a sub discharge outlet 100C. In addition, the sheet post-processing device 100 includes a main tray T1 and a sub tray T2. The main discharge outlet 100B corresponds to a "discharge outlet", and the main tray T1 corresponds to a "discharge tray".

The carry-in entrance 100A is disposed on the side of the sheet post-processing device 100, which is the side connected to the image forming apparatus 200. The sheet S is carried into the sheet post-processing device 100 from the image forming apparatus 200 through the carry-in entrance 100A. The main discharge outlet 100B and the sub discharge outlet 100C are disposed on the side of the sheet post-processing device 100, which is opposite to the side connected to the image forming apparatus 200. The sheet S is discharged to the outside of the sheet post-processing device 100 through either the main discharge outlet 100B or the sub discharge outlet 100C.

The main tray T1 and the sub tray T2 are disposed on the side of the sheet post-processing device 100, which is opposite to the side connected to the image forming apparatus 200. The sub tray T2 is disposed above the main tray T1. The sheet post-processing device 100 discharges the sheets S onto the main tray T1 or the sub tray T2. The main tray T1 loads the sheet S discharged from the main discharge outlet 100B, and the sub tray T2 loads the sheet S discharged from the sub discharge outlet 100C.

The sheet post-processing device 100 has a first conveying path P1 and a second conveying path P2. The first conveying path P1 and the second conveying path P2 are conveying paths for the sheet S. The first conveying path P1 extends from the carry-in entrance 100A in a substantially horizontal direction, so as to reach the main discharge outlet 100B. The second conveying path P2 branches from the first conveying path P1 in the upper left direction, so as to reach the sub discharge outlet 100C.

The sheet S is conveyed from the carry-in entrance 100A to the main tray T1 or the sub tray T2. The sheet S is conveyed from the right to the left in FIG. 2. In other words, the direction from the right to the left in FIG. 2 is a sheet conveying direction. In the following description, the direction perpendicular to the sheet conveying direction is referred to as a width direction Dw. The width direction Dw is the direction perpendicular to the up and down direction of the sheet post-processing device 100, and is the front and back direction of the sheet post-processing device 100 (the direction perpendicular to the paper of FIG. 2).

The sheet post-processing device 100 includes a punching unit U1, a folding unit U2, a stapling unit U3, and a booklet unit U4. The punching unit U1, the folding unit U2, the stapling unit U3, and the booklet unit U4 each perform the corresponding post-processing on the sheet S.

The punching unit U1 is disposed on an upstream side of the first conveying path P1 in the sheet conveying direction. The punching unit U1 performs the punching process as the post-processing to form punch holes in the sheet S. The folding unit U2 is disposed on a downstream side of the punching unit U1 in the sheet conveying direction. The folding unit U2 performs the folding process as the post-processing to fold the sheet S.

The stapling unit U3 performs the stapling process as the post-processing to staple a bunch of a plurality of the sheets S with staple needles. Hereinafter, the bunch of the plurality of sheets S may be referred to simply as a bunch of sheets S. Here, the sheet post-processing device 100 includes a processing tray 1. When the stapling process is performed, the plurality of sheets S are loaded onto the processing tray 1. Then, the stapling process is performed on the plurality of sheets S on the processing tray 1.

After the stapling process, a bundle of the sheets S after stapling with the staple needles is discharged onto the main tray T1. In this structure, the stapling process corresponds to "predetermined post-processing", and the stapling unit U3 corresponds to a "post-processing section". Note that a loading process of the sheet S onto the processing tray 1 will be described later in detail.

The booklet unit U4 performs the booklet process as the post-processing in which the bundle of sheets S stapled in the middle is folded in the middle. The booklet unit U4 includes a stapling unit to staple in the middle, and uses the stapling unit so as to staple the bunch of sheets S in the middle with the staple needles.

For instance, the sheet post-processing device 100 includes a third conveying path P3 that branches from the first conveying path P1 to extend downward. The third conveying path P3 connects to the booklet unit U4. When the booklet process is performed, the sheets S are conveyed to the booklet unit U4 via the third conveying path P3.

In addition, the sheet post-processing device 100 includes a booklet tray T3. The booklet tray T3 is disposed on the side of the sheet post-processing device 100, which is opposite to the side connected to the image forming apparatus 200. The booklet tray T3 is disposed below the main tray T1. A booklet obtained by the booklet process is discharged onto the booklet tray T3.

Note that the sheet post-processing device 100 includes a control unit 10. The control unit 10 includes a processing circuit such as a CPU and an ASIC. In addition, the control unit 10 includes a storage device such as a ROM and a RAM. The control unit 10 controls the post-processing performed by the sheet post-processing device 100.

For instance, the control unit 10 communicates with a main control unit (not shown) that controls the image forming apparatus 200. The control unit 10 receives job information from the main control unit, the job information being about the post-processing to be performed by the sheet post-processing device 100. The job information includes, for example, information about a size of the sheet S, the number of the sheets S in the bundle, a stapling position of the sheet S, and the like.

<Structure of Conveying Roller Pair>

The sheet post-processing device 100 includes a plurality of conveying roller pairs as illustrated in FIG. 2. The plurality of conveying roller pairs each include a pair of rollers that are pressed to contact each other. The plurality of conveying roller pairs each nip the sheet S between the pair of rollers and rotate, so as to convey the sheet S.

Here, the sheet post-processing device 100 includes an intermediate roller pair 2 as one of the conveying roller pairs, which is disposed in the first conveying path P1. The intermediate roller pair 2 is disposed on the downstream side of the folding unit U2 in the sheet conveying direction. The intermediate roller pair 2 conveys the sheet S to the main discharge outlet 100B, and allows a front end Sf of the sheet S to protrude above the main tray T1 via the main discharge outlet 100B.

In addition, the sheet post-processing device 100 includes a discharge roller pair 3 as one of the conveying roller pairs, which is disposed in the first conveying path P1. The discharge roller pair 3 is disposed on the downstream side of the intermediate roller pair 2 in the sheet conveying direction. Specifically, the discharge roller pair 3 is disposed in the main discharge outlet 100B. The discharge roller pair 3 nips the sheet S (including the bunch of sheets S) at the main discharge outlet 100B, and discharges the sheet S onto the main tray T1. The discharge roller pair 3 corresponds to a "discharging member".

The discharge roller pair 3 includes an upper roller 31 and a lower roller 32. The upper roller 31 is disposed on the upside of a conveying path of the sheet S, and the lower roller 32 is disposed on the downside of the conveying path of the sheet S. The upper roller 31 and the lower roller 32 are pressed to contact each other via the conveying path of the sheet S. The discharge roller pair 3 nips the sheet S between the upper roller 31 and the lower roller 32 and rotates. In this way, the sheet S is discharged from the main discharge outlet 100B onto the main tray T1.

The upper roller 31 is supported at one end of a roller arm (not shown). The roller arm is rotatable about a rotation shaft at the other end thereof, so as to swing the one end in the up and down direction. In this way, the upper roller 31 can be separated from the lower roller 32. In addition, the upper roller 31 can be pressed to contact with the lower roller 32. When discharging the sheet S onto the main tray T1, the upper roller 31 and the lower roller 32 are pressed to contact each other via the sheet S.

<Structure of Processing Tray>

Figure 3:
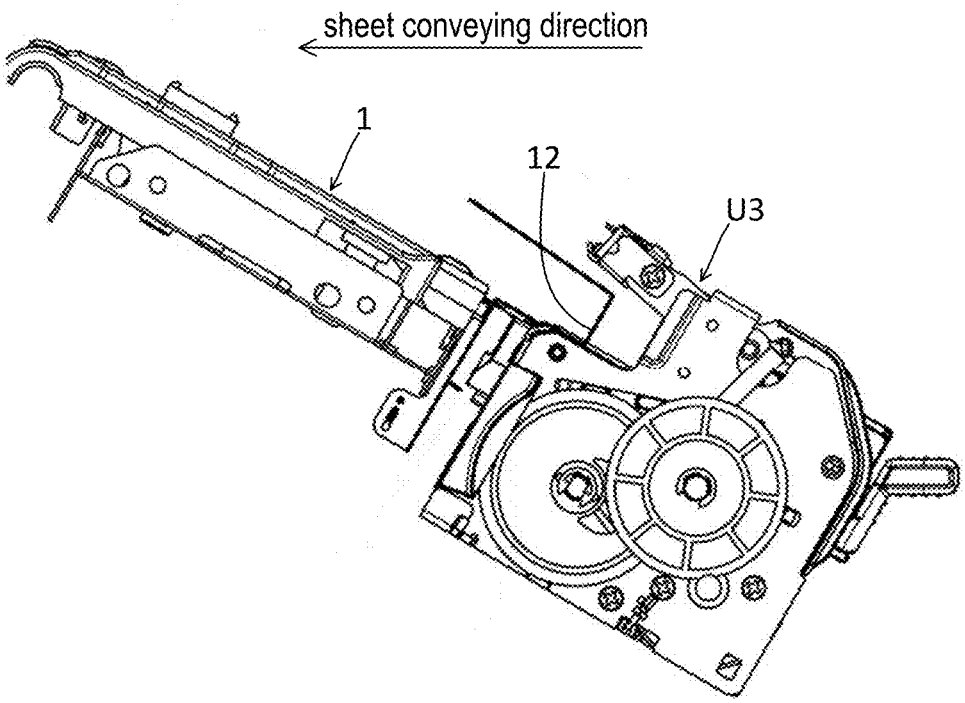
FIG. 3 is a side view of a processing tray and its vicinity of the sheet post-processing device according to one embodiment.

As illustrated in FIGS. 2 and 3, the processing tray 1 is disposed at a processing position, and is inclined downward from the downstream side to the upstream side in the sheet conveying direction. The position of the processing tray 1 illustrated in FIG. 2 is the processing position. The processing tray 1 is inclined downward from one end side to the other end side. Viewed from the front of the sheet post-processing device 100 (viewed in the front and back direction), the left end of the processing tray 1 is the one end, and the right end of the processing tray 1 is the other end. In other words, the processing tray 1 is inclined downward from the left to the right viewed from the front of the sheet post-processing device 100.

The one end of the processing tray 1 is disposed at the main discharge outlet 100B. In other words, the processing tray 1 is inclined downward from the main discharge outlet 100B to the upstream side in the sheet conveying direction. The lower roller 32 is disposed at the one end of the processing tray 1.

The stapling unit U3 is disposed at the other end of the processing tray 1. When the stapling process is performed, the plurality of sheets S are loaded on the processing tray 1. The stapling unit U3 performs the stapling process on the plurality of sheets S on the processing tray 1.

Figure 4:
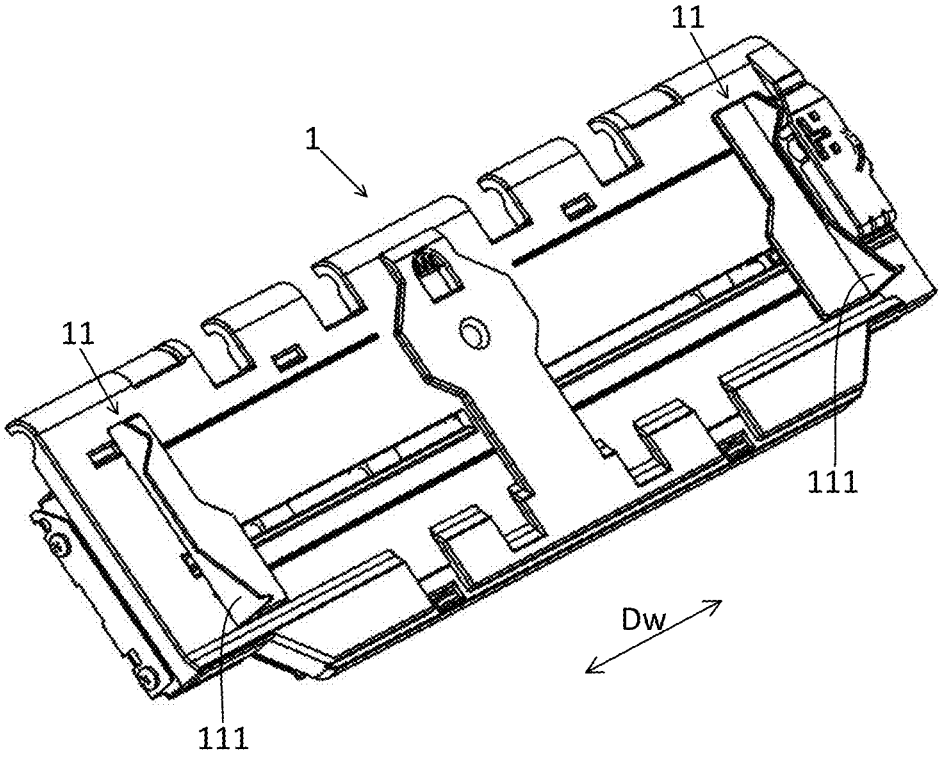
FIG. 4 is a perspective view of the processing tray of the sheet post-processing device according to one embodiment.

The processing tray 1 has a structure as illustrated in FIG. 4. The processing tray 1 is provided with a pair of processing tray cursors 11. In other words, the sheet post-processing device 100 includes the pair of processing tray cursors 11.

The pair of processing tray cursors 11 include a cursor disposed on one side and a cursor disposed on the other side with respect to the center of the processing tray 1 in the width direction Dw. In other words, the pair of processing tray cursors 11 are disposed with a space therebetween in the width direction Dw. In addition, the pair of processing tray cursors 11 each have a side wall 111. The pair of side walls 111 face each other in the width direction Dw.

The pair of processing tray cursors 11 are configured to be movable in a reciprocation manner in the width direction Dw independently of each other on the processing tray 1. Specifically, the processing tray 1 has a pair of drive mechanisms (not shown) connected to the pair of processing tray cursors 11, respectively. The structure of the pair of drive mechanisms is not particularly limited. For instance, the pair of drive mechanisms each includes a processing tray motor, a plurality of pulleys including a drive pulley rotated by a drive force of the processing tray motor, and an endless belt stretched around the plurality of pulleys. The pair of processing tray cursors 11 are connected to the belts of the corresponding drive mechanisms, respectively. Note that the control unit 10 controls the processing tray motor.

The pair of processing tray cursors 11 are each controlled by the processing tray motor of the corresponding drive mechanism, so as to move in the width direction Dw on the processing tray 1. Further, the pair of processing tray cursors 11 sandwich the sheets S in the width direction Dw on the processing tray 1. In this way, the sheets S are aligned in the width direction Dw on the processing tray 1.

A reference plate 12 (see FIG. 3) is disposed on the other end of the processing tray 1. A rear end Sr of the sheet S loaded onto the processing tray 1 abuts the reference plate 12. When the rear end Sr of the sheet S abuts the reference plate 12, the rear end position of the sheet S is aligned.

<Loading of Sheets Onto Processing Tray>

Figure 5:
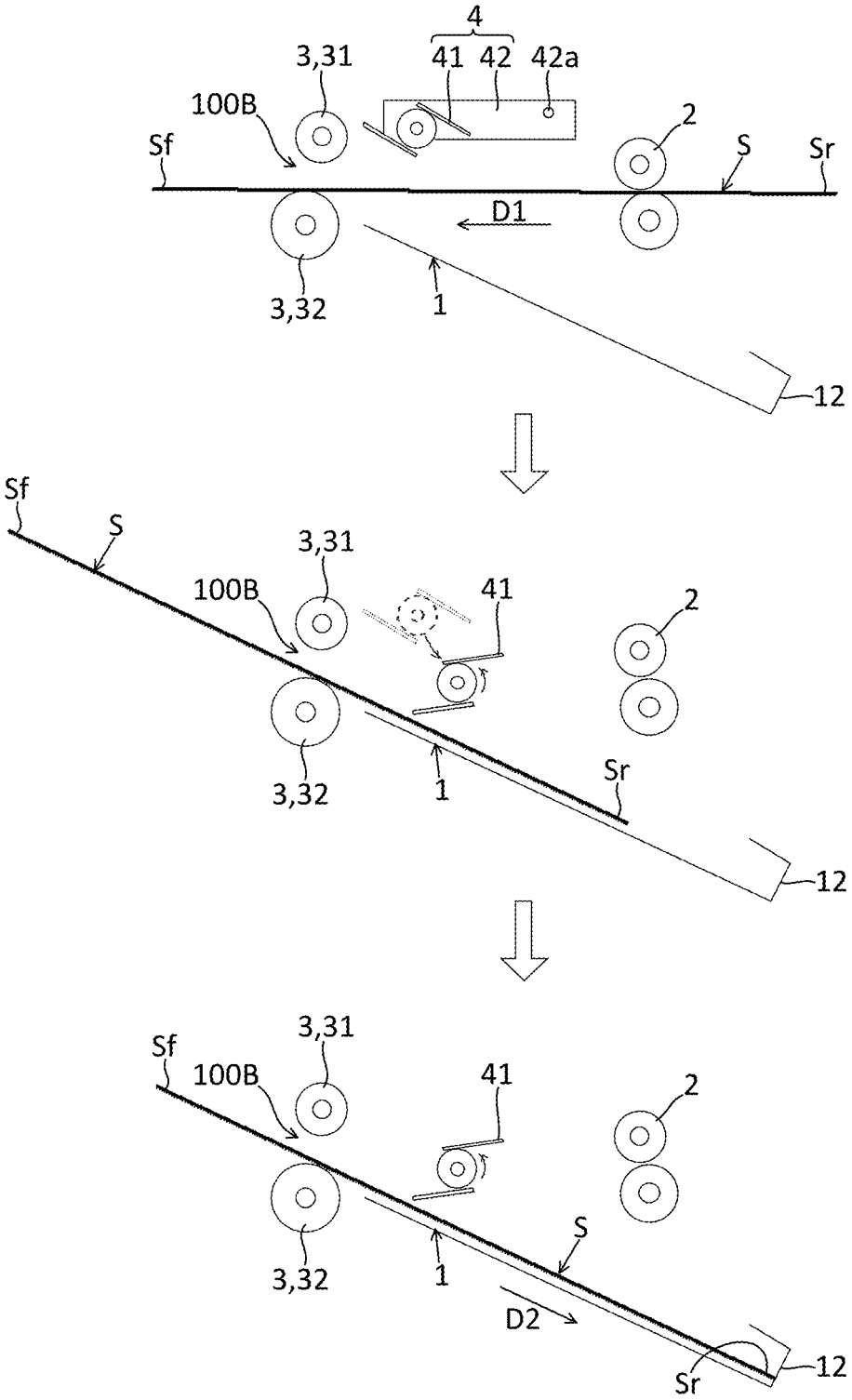
FIG. 5 is a diagram illustrating a flow when a sheet is loaded onto the processing tray of the sheet post-processing device according to one embodiment.

The sheet post-processing device 100 includes a pull-in member 4 as illustrated in FIG. 5. When performing the stapling process on the sheets S, i.e., when loading the sheet S onto the processing tray 1, the pull-in member 4 pulls in the sheet S to the processing position. When the sheet S is not loaded onto the processing tray 1, the pull-in member 4 does not pull in the sheet S to the processing position. The pull-in member 4 includes a paddle 41 and a paddle holder 42.

The paddle 41 is disposed above the processing tray 1. The paddle 41 includes a pair of rubber sheets. The pair of rubber sheets protrude in tangential directions (to upstream sides in the rotation direction) from point-symmetric positions on an outer periphery of a rotation shaft extending in the width direction Dw. The paddle 41 is rotated by a drive force transmitted from a not-shown motor. In FIG. 5, the paddle 41 rotates in a counterclockwise direction.

The paddle holder 42 supports the paddle 41 in a rotatable manner at one end thereof. In addition, the paddle holder 42 has a swing shaft 42*a* at the other end thereof. The paddle holder 42 can swing about the swing shaft 42*a* as a fulcrum so that the one end supporting the paddle 41 is swung in the up and down direction. The paddle holder 42 is swung by a drive force transmitted from a not-shown motor.

After the rear end Sr of the sheet S conveyed by the intermediate roller pair 2 passes the intermediate roller pair 2, the front end Sf of the sheet S protrudes from the main discharge outlet 100B above the main tray T1, and in this state the pull-in member 4 switches back the sheet S so as to pull in the sheet S to the processing position. When the pull-in member 4 pulls in the sheet S, the rear end Sr of the sheet S abuts the reference plate 12. In other words, the pull-in member 4 pulls in the sheet S so as to load the sheet S onto the processing tray 1.

Hereinafter, with reference to FIG. 5, the loading process of the sheet S onto the processing tray 1 is described in detail. In FIG. 5, the sheet S is illustrated by a thick line.

First, as illustrated in the upper part of FIG. 5, the paddle 41 is retained at a retreat position not contacting with the sheet S (the position illustrated in the upper part of FIG. 5). In addition, the nip of the discharge roller pair 3 (the state of the upper roller 31 pressed to contact with the lower roller 32) is released. In this state, the sheet S is conveyed by the intermediate roller pair 2. In this way, the front end Sf of the sheet S that is being conveyed by the intermediate roller pair 2 protrudes from the main discharge outlet 100B above the main tray T1. In the upper part of FIG. 5, the sheet conveying direction of the intermediate roller pair 2 is illustrated by an arrow D1.

Further, as illustrated in the middle part of FIG. 5, when the rear end Sr of the sheet S that is being conveyed by the intermediate roller pair 2 passes the intermediate roller pair 2, the paddle 41 moves toward the processing tray 1, and the paddle 41 contacts with the sheet S so that the sheet S becomes along the top surface of the processing tray 1. Further, the paddle 41 rotates while contacting with the sheet S. Note that it may be possible to tap the sheet S toward the processing tray 1 using a not-shown tapping member, when the rear end Sr of the sheet S that is being conveyed by the intermediate roller pair 2 passes the intermediate roller pair 2.

When the paddle 41 rotates while contacting with the sheet S, the sheet S is moved along the top surface of the processing tray 1 toward the reference plate 12 as illustrated in the lower part of FIG. 5. In other words, the sheet S slips down along the top surface of the processing tray 1. In still other words, the sheet S is switched back. As a result, the rear end Sr of the sheet S abuts the reference plate 12. In the lower part of FIG. 5, the moving direction of the sheet S is illustrated by an arrow D2.

After that, the paddle 41 moves to the retreat position. Further, the same operation is repeated until the number of the sheets S loaded onto the processing tray 1 reaches a set number.

When the number of the sheets S loaded onto the processing tray 1 reaches the set number, the bunch of sheets S on the processing tray 1 are sandwiched by the pair of processing tray cursors 11 in the width direction Dw, and in this state the stapling process is performed. After that, the discharge roller pair 3 conveys the sheets S on the processing tray 1 to the main discharge outlet 100B, and discharges the sheets S onto the main tray T1 via the main discharge outlet 100B. In other words, the bundle of sheets S on the processing tray 1 is nipped by the discharge roller pair 3 and is discharged onto the main tray T1.

Figure 6:
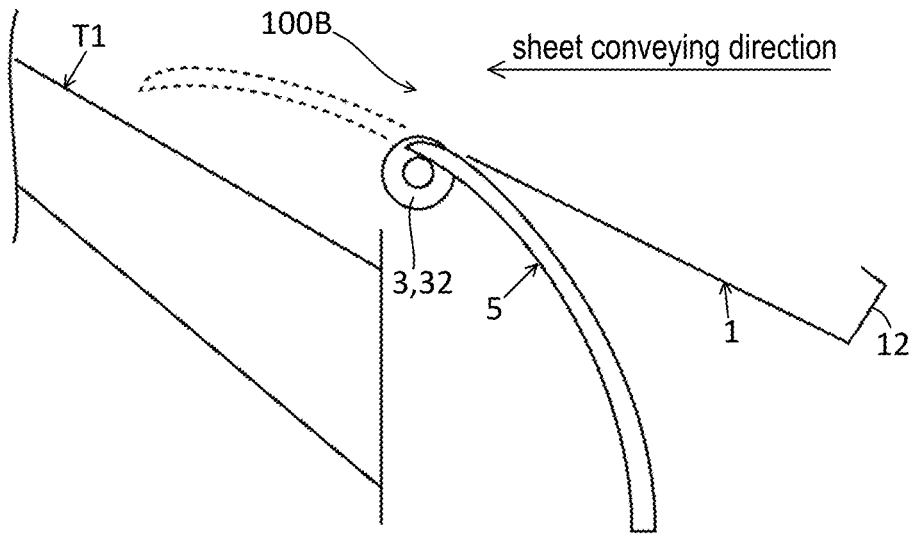
FIG. 6 is a schematic diagram of a support member of the sheet post-processing device according to one embodiment.

For instance, the sheet post-processing device 100 includes a support member 5 as illustrated in FIG. 6. The support member 5 is disposed below the processing tray 1. The support member 5 is a rod-like member and is formed in an arc shape. The support member 5 is movable between a retreat position to retreat to the upstream side of the lower roller 32 in the sheet conveying direction (the position indicated by a solid line in FIG. 6), and a protruding position to protrude to the downstream side of the lower roller 32 in the sheet conveying direction (the position indicated by a broken line in FIG. 6).

When the sheet S is loaded onto the processing tray 1, the support member 5 is positioned at the protruding position. In this way, the front end Sf of the sheet S protruding from the main discharge outlet 100B above the main tray T1 is supported by the support member 5.

<Alignment of Sheet on Main Tray>

Figure 7:
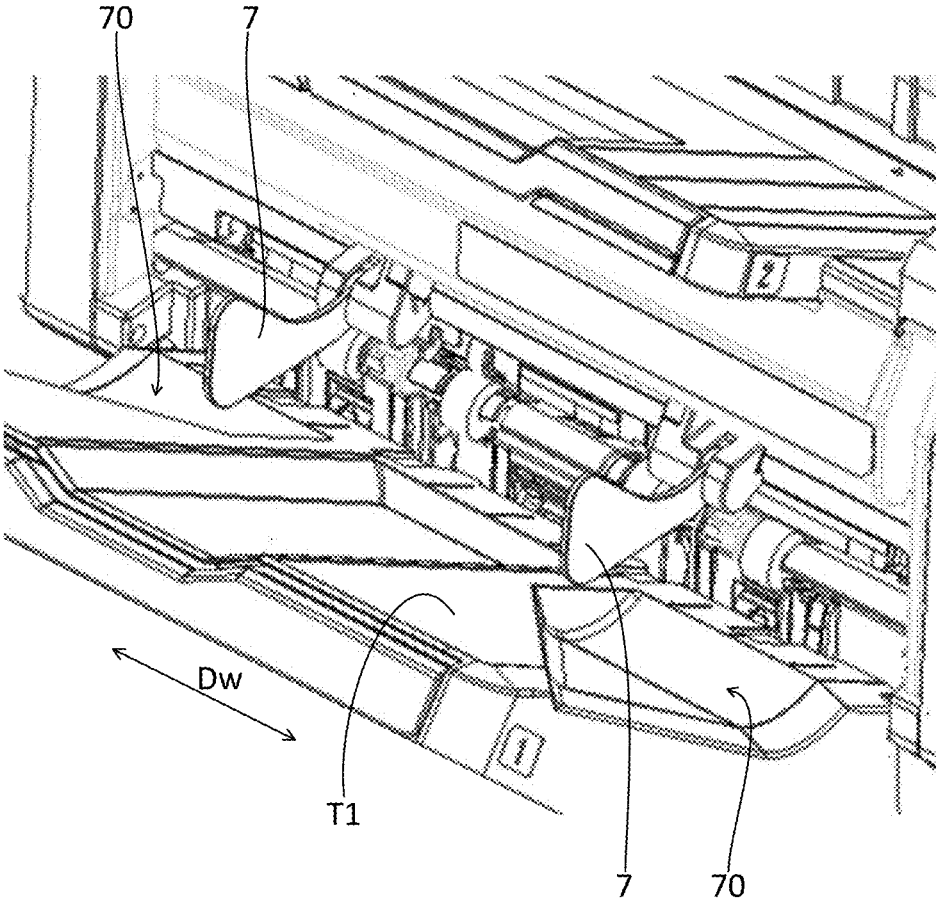
FIG. 7 is a perspective view of a main tray and its vicinity of the sheet post-processing device according to one embodiment.
Figure 8:
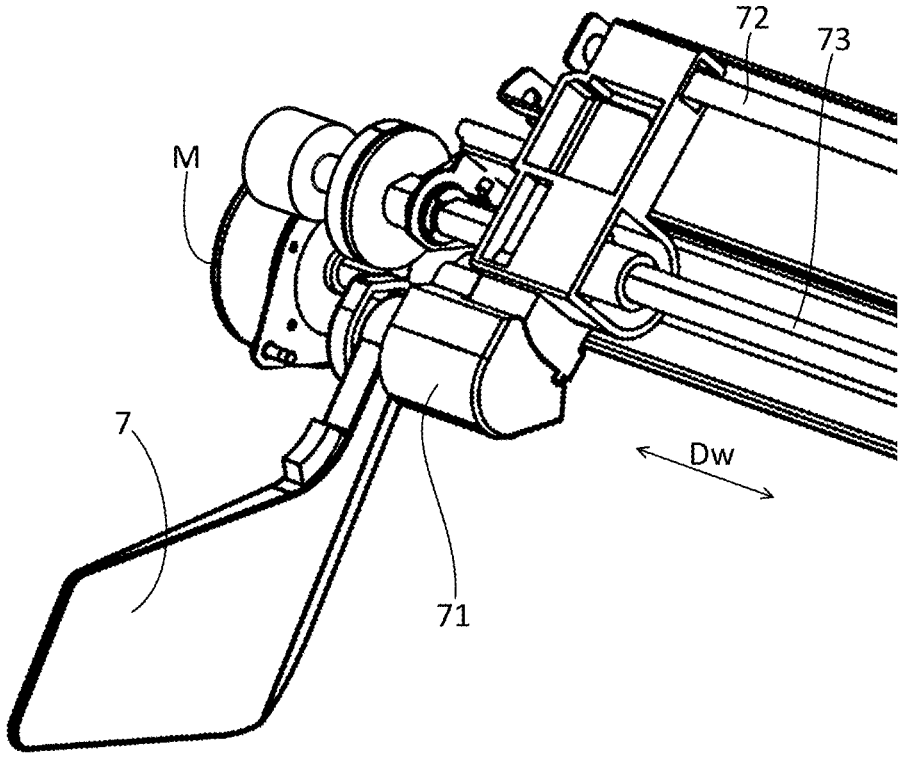
FIG. 8 is a perspective view of a main tray cursor and its vicinity of the sheet post-processing device according to one embodiment.
Figure 9:
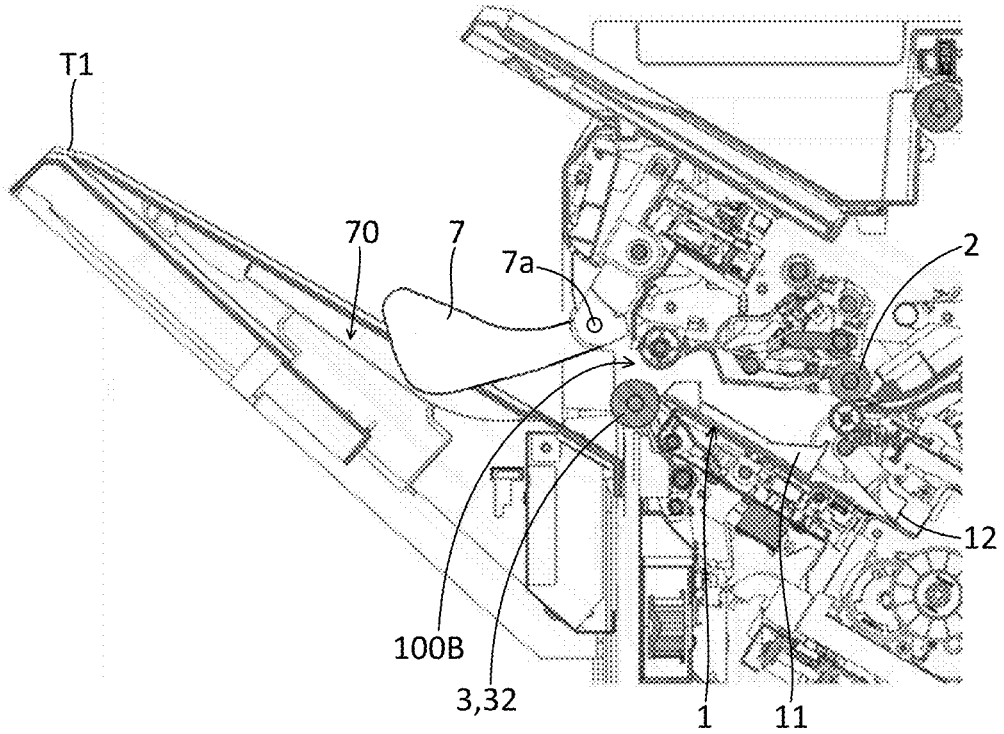
FIG. 9 is a diagram illustrating a position of the main tray cursor in the up and down direction when performing alignment of the sheet discharged onto the main tray of the sheet post-processing device according to one embodiment.

The sheet post-processing device 100 includes a pair of main tray cursors 7 as illustrated in FIGS. 7 to 9. The main tray cursor 7 corresponds to a "discharge tray cursor". The pair of main tray cursors 7 align the sheet S in the width direction Dw above the main tray T1. Therefore, the pair of main tray cursors 7 are configured to be movable in a reciprocation manner in the width direction Dw above the main tray T1 independently of each other. The pair of main tray cursors 7 are moved in the width direction Dw by separate width direction drive mechanisms.

Hereinafter, a structure of the width direction drive mechanism is described. Note that the width direction drive mechanisms of the pair of main tray cursors 7 have the same structure. Therefore, in the following description, the width direction drive mechanism of one of the main tray cursors 7 is noted, and the structure thereof is described. The structure of the width direction drive mechanism of the other main tray cursor 7 is omitted by referring to the following description.

The width direction drive mechanism includes a carriage 71. The main tray cursor 7 is supported by the carriage 71. The carriage 71 is supported by a guide shaft 72. The guide shaft 72 is disposed above the main discharge outlet 100B and extends in the width direction Dw. The carriage 71 moves along the guide shaft 72 in the width direction Dw. In other words, the guide shaft 72 guides movement of the carriage 71 in the width direction Dw.

Although not illustrated, the width direction drive mechanism includes, for example, a width position adjusting motor, a plurality of pulleys including a drive pulley rotated by a drive force of the width position adjusting motor, an endless belt stretched around the plurality of pulleys, and the like. The carriage 71 is connected to a belt of the width direction drive mechanism. In this structure, when the width position adjusting motor works, the main tray cursor 7 moves together with the carriage 71 in the width direction Dw. Note that the control unit 10 controls the width position adjusting motor.

In addition, the pair of main tray cursors 7 are each configured to be rotatable so as to swing one end thereof opposite to the end supported by the carriage 71, in the up and down direction. In other words, the pair of main tray cursors 7 each can move in the up and down direction. The pair of main tray cursors 7 rotate by an up and down direction drive mechanism.

The up and down direction drive mechanism includes an up and down direction adjusting motor M for rotating a drive shaft 73. The drive shaft 73 extends in the width direction Dw. The drive shaft 73 is inserted into a pair of the carriages 71. However, even if the drive shaft 73 rotates, the pair of the carriages 71 do not rotate. The pair of the carriages 71 can move along the drive shaft 73 in the width direction Dw.

The up and down direction adjusting motor M is connected to one end of the drive shaft 73 via a transmission member such as gears. In addition, the drive shaft 73 is connected to rotation shafts 7*a* of the pair of main tray cursors 7 via a transmission member such as gears (see FIG. 9). In this way, when the up and down direction adjusting motor M works, the pair of main tray cursors 7 rotate. In other words, when the up and down direction adjusting motor M works, the pair of main tray cursors 7 move in the up and down direction. Note that the control unit 10 controls the up and down direction adjusting motor M.

For instance, the main tray T1 has a recess 70 formed on the top surface on which the sheet S is loaded. Further, when aligning the sheet S discharged onto the main tray T1, the pair of main tray cursors 7 are partly inserted in the recess 70. Specifically, in the state illustrated in FIG. 9, the alignment is performed by the pair of main tray cursors 7. In other words, when aligning the sheet S on the main tray T1 (i.e., the sheet S discharged and loaded onto the main tray T1), the control unit 10 sets the pair of main tray cursors 7 at a first position to face side edges of the sheet S loaded on the main tray T1. The position of the pair of main tray cursors 7 in the up and down direction illustrated in FIG. 9 is the first position.

<Rear End Alignment Process and Front End Alignment Process>

When the sheet S is loaded onto the processing tray 1, the control unit 10 performs a rear end alignment process in which the pair of processing tray cursors 11 sandwich the rear end Sr of the sheet S positioned on the processing tray 1 in the width direction Dw. By performing the rear end alignment process, the control unit 10 aligns the sheet S on the processing tray 1.

Figure 10:
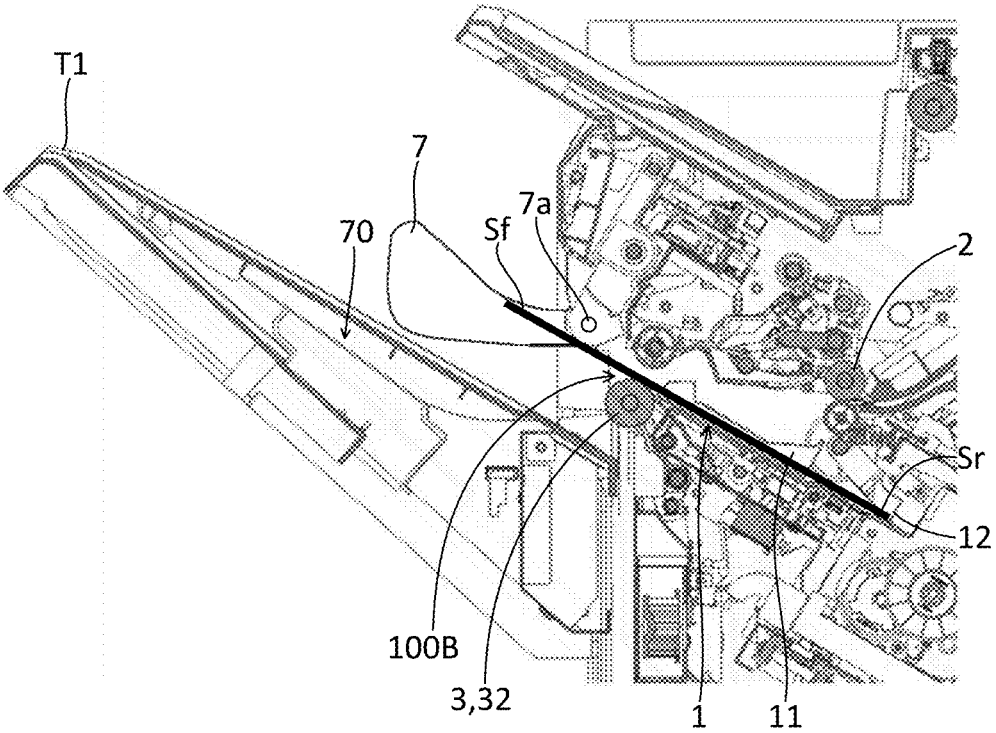
FIG. 10 is a diagram illustrating a position of the main tray cursor in the up and down direction when performing alignment of the sheet loaded on the processing tray of the sheet post-processing device according to one embodiment.

Here, the sheets S on which the sheet post-processing device 100 performs the post-processing may have various sizes. Therefore, depending on a size of the sheet S, as illustrated in FIG. 10, when the sheet S is pulled in onto the processing tray 1 so that the rear end Sr of the sheet S abuts the reference plate 12, the front end Sf of the sheet S protrudes from the main discharge outlet 100B above the main tray T1. In FIG. 10, the sheet S is illustrated by a thick line.

If the sheet S having the front end Sf protruding above the main tray T1 is largely skewed, a disadvantage may occur that it is difficult to align the sheet S only by the rear end alignment process. For instance, as the sheet S is wet with ink, friction resistance between upper and lower sheets S may increase. In this case, alignment of the sheet S becomes difficult.

Therefore, when performing the alignment process on the sheet S loaded onto the processing tray 1, in a state where the front end Sf of the sheet S is protruded from the main discharge outlet 100B onto the main tray T1, the control unit 10 performs a front end alignment process in addition to the rear end alignment process. The control unit 10 performs the front end alignment process, in which the pair of main tray cursors 7 sandwich the front end Sf of the sheet S protruded above the main tray T1 in the width direction Dw.

In this embodiment, as described above, when the sheet S is loaded onto the processing tray 1, in addition to the rear end alignment process, in which the rear end Sr of the sheet S is sandwiched by the pair of processing tray cursors 11 in the width direction Dw, the front end alignment process is performed, so that the front end Sf of the sheet S is sandwiched by the pair of main tray cursors 7 in the width direction Dw. Therefore, in the case where the front end Sf of the sheet S loaded on the processing tray 1 is protruded above the main tray T1, even if the sheet S loaded on the processing tray 1 is largely skewed, alignment of the sheet S can be securely performed.

Figure 11:
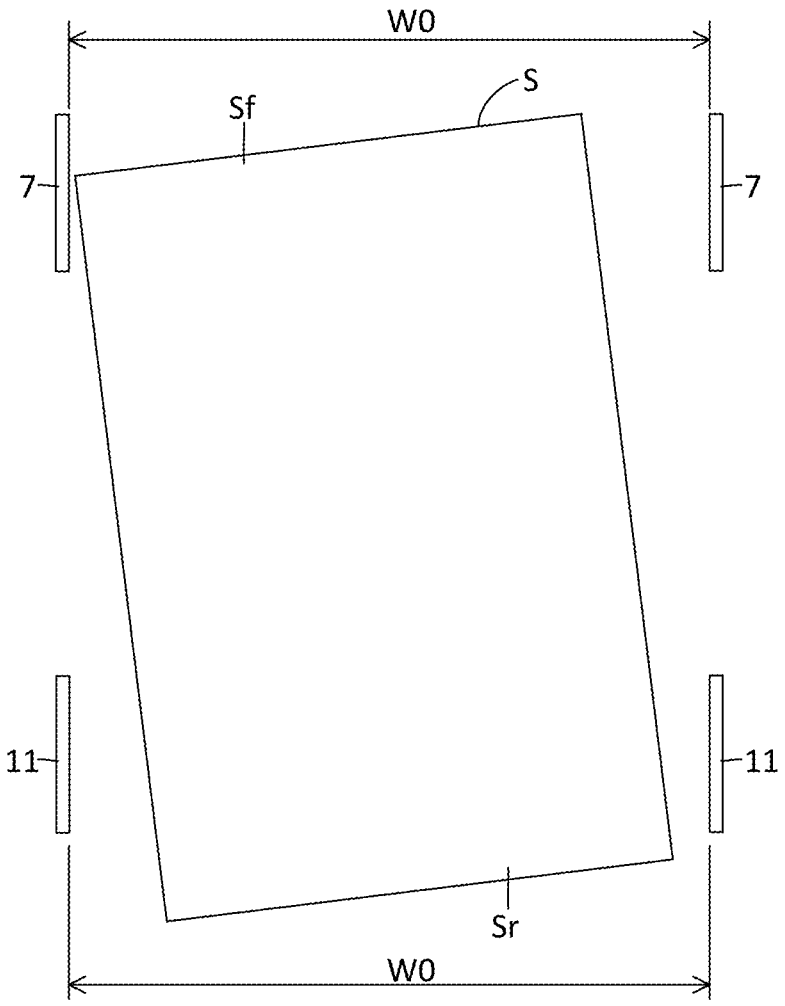
FIG. 11 is a schematic diagram illustrating a condition where a sheet is loaded on the processing tray of the sheet post-processing device according to one embodiment.
Figure 12:
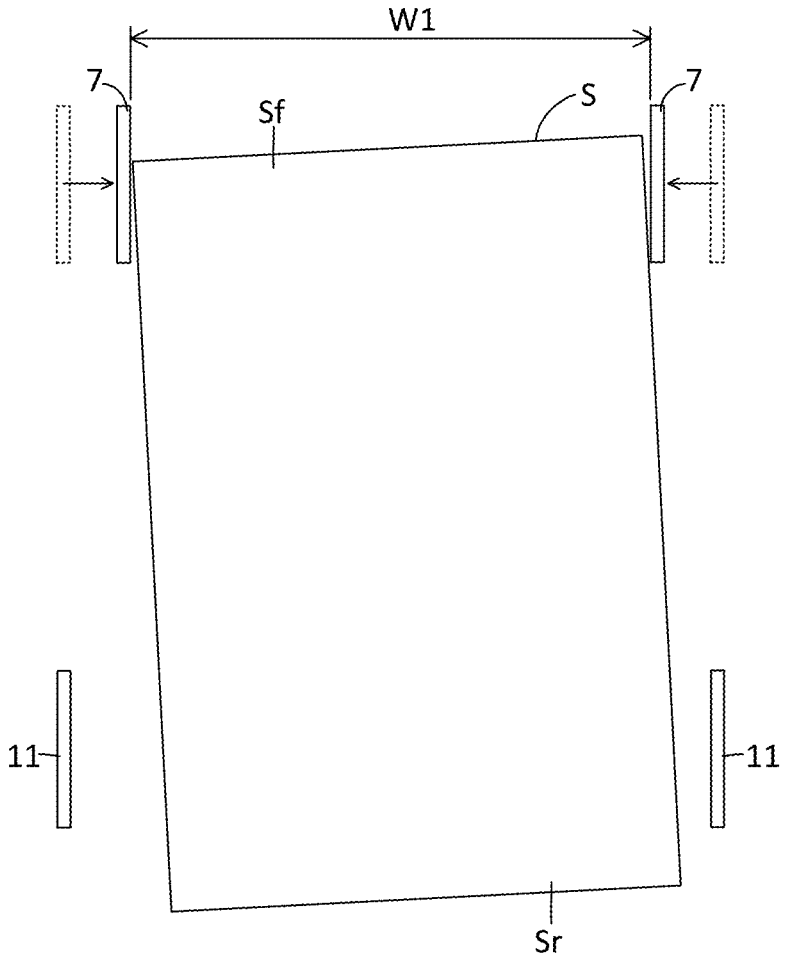
FIG. 12 is a schematic diagram for illustrating a front end alignment process that is performed by the sheet post-processing device according to one embodiment.
Figure 13:
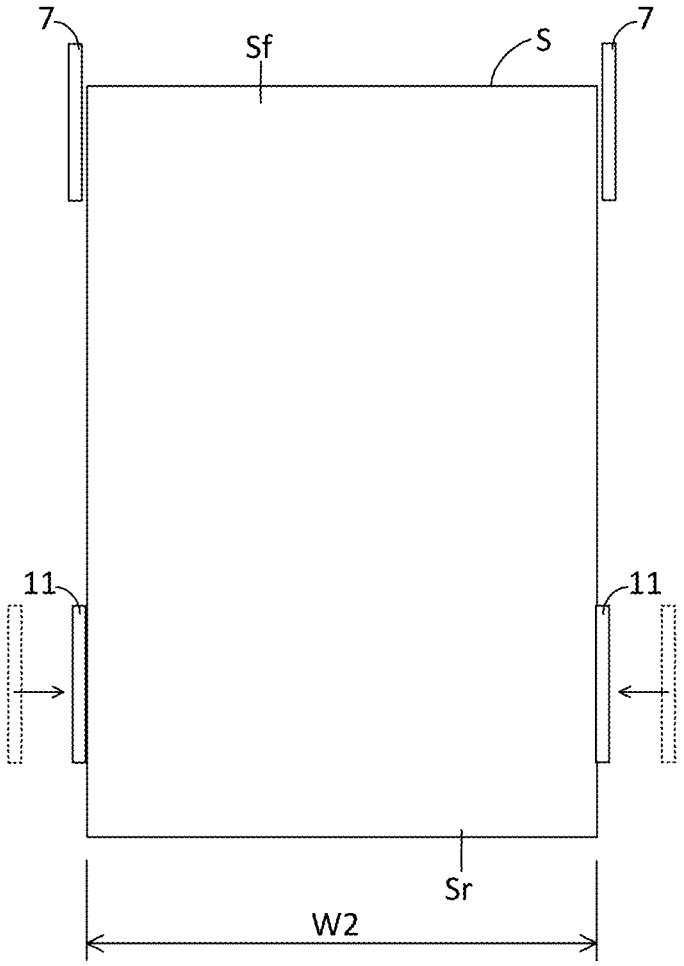
FIG. 13 is a schematic diagram for illustrating a rear end alignment process that is performed by the sheet post-processing device according to one embodiment.

Hereinafter, with reference to FIGS. 11 to 13, there is described a flow of the alignment process performed on the sheet S loaded on the processing tray 1. FIGS. 11 to 13 are schematic diagrams of the sheet S loaded on the processing tray 1 viewed from above. In FIGS. 11 to 13, the direction from down to up in the figure corresponds to the sheet conveying direction. In addition, the left and right direction in the figure corresponds to the width direction Dw. The same is true in FIGS. 14 and 15 that will be referred to in the later description.

Note that in FIGS. 11 and 12, the sheet S with a large skew on the processing tray 1 is illustrated for convenience sake, for easy understanding of movement of the sheet S when the front end alignment process and the rear end alignment process are performed.

First, as illustrated in FIG. 11, when the sheet S is loaded onto the processing tray 1, the control unit 10 keeps the interval between the pair of main tray cursors 7 in the width direction Dw to be an initial interval W0. In the same manner, the control unit 10 keeps the interval between the pair of processing tray cursors 11 in the width direction Dw to be the initial interval W0.

The initial interval W0 is larger than the size in the width direction Dw of the sheet S that is loaded onto the processing tray 1 this time. The initial interval W0 varies depending on the size of the sheet S in the width direction Dw. As the size of the sheet S in the width direction Dw is larger, the initial interval W0 is larger.

In addition, the initial interval W0 may be the same or different between the pair of main tray cursors 7 and the pair of processing tray cursors 11. It is sufficient that the initial interval W0 of the pair of main tray cursors 7 is larger than a first interval W1 that will be described later. It is sufficient that the initial interval W0 of the pair of processing tray cursors 11 is larger than a second interval W2 that will be described later.

For instance, when loading the sheet S onto the processing tray 1 so as to align the sheet S on the processing tray 1, the control unit 10 sets the position of the pair of main tray cursors 7 in the up and down direction to be the second position (the position for the front end alignment process). The position of the pair of main tray cursors 7 in the up and down direction illustrated in FIG. 10 is the second position. The second position is a position higher than the first position when aligning the sheet S discharged onto the main tray T1, and is a position facing the side edge of the front end Sf of the sheet S protruding above the main tray T1 (a position contactable with the front end Sf of the sheet S in the width direction Dw).

The control unit 10 maintains the interval between the pair of main tray cursors 7 to be the initial interval W0, and the interval between the pair of processing tray cursors 11 to be the initial interval W0, while it maintains the position of the pair of main tray cursors 7 in the up and down direction to be a predetermined position, and in this state it pulls in and loads the sheet S onto the processing tray 1.

When the sheet S is loaded onto the processing tray 1, the control unit 10 performs the front end alignment process as illustrated in FIG. 12. Specifically, the control unit 10 decreases the interval of the pair of main tray cursors 7 in the width direction Dw to the first interval W1 smaller than the initial interval W0. In other words, the control unit 10 controls the pair of main tray cursors 7 to sandwich the front end Sf of the sheet S to perform alignment in the width direction Dw.

The first interval W1 is larger than the size of the sheet S in the width direction Dw and is smaller than the initial interval W0. For instance, the first interval W1 is larger than the size of the sheet S in the width direction Dw by a predetermined amount. In other words, the first interval W1 is a little larger than the size of the sheet S in the width direction Dw. The first interval W1 varies depending on the size of the sheet S in the width direction Dw. As the size of the sheet S in the width direction Dw is larger, the first interval W1 is larger.

After the front end alignment process, as illustrated in FIG. 13, the control unit 10 performs the rear end alignment process. Specifically, the control unit 10 decreases the interval between the pair of processing tray cursors 11 in the width direction Dw to the second interval W2 smaller than the initial interval W0. In other words, the control unit 10 controls the pair of processing tray cursors 11 to sandwich the rear end Sr of the sheet S to perform alignment in the width direction Dw.

The second interval W2 is the same (or substantially the same) as the size of the sheet S in the width direction Dw, and is smaller than the first interval W1. In other words, the interval between the pair of main tray cursors 7 in the width direction Dw when performing the front end alignment process (the first interval W1) is larger than the interval between the pair of processing tray cursors 11 in the width direction Dw when performing the rear end alignment process (the second interval W2). The second interval W2 varies depending on the size of the sheet S in the width direction Dw. As the size of the sheet S in the width direction Dw is larger, the second interval W2 is larger.

In this embodiment, as described above, the first interval W1 is different from the second interval W2. Further, the control unit 10 sets different execution timings for the front end alignment process and the rear end alignment process, respectively. Specifically, the control unit 10 performs the front end alignment process and then performs the rear end alignment process.

In the rear end alignment process, the interval between the pair of processing tray cursors 11 is the same as the size of the sheet S in the width direction Dw. On the other hand, in the front end alignment process, the interval between the pair of main tray cursors 7 is a little larger than the size of the sheet S in the width direction Dw. Therefore, by performing the rear end alignment process after the front end alignment process, a skew of the sheet S can be roughly corrected before the sheet S is formally aligned (before the rear end alignment process).

Here, the control unit 10 performs the front end alignment process and the rear end alignment process every time when one sheet S is loaded onto the processing tray 1. In this way, the sheets S on the processing tray 1 can be securely aligned one by one.

In a case where the front end alignment process and the rear end alignment process are performed on one sheet S, and then the front end alignment process and the rear end alignment process are performed on second and subsequent sheets S, when the second and subsequent sheets S are loaded onto the processing tray 1, the control unit 10 sets the interval between the pair of main tray cursors 7 to be larger than the first interval W1 (the interval in the front end alignment process), and sets the interval between the pair of processing tray cursors 11 to be larger than the second interval W2 (the interval when performing the rear end alignment process). Further, in this state, the control unit 10 pulls in and loads a new sheet S onto the processing tray 1, so as to perform the front end alignment process and the rear end alignment process. The interval larger than the first interval W1 described above is the initial interval W0, and the interval larger than the second interval W2 described above is the initial interval W0. In other words, when a plurality of sheets S are sequentially carried in and loaded onto the processing tray 1, the control unit 10 repeats a series of processes illustrated in FIGS. 11 to 13.

When discharging the sheet S from the processing tray 1 to the main tray T1, the control unit 10 maintains the position of the pair of main tray cursors 7 in the up and down direction to be a predetermined position. Therefore, if the interval between the pair of main tray cursors 7 in the width direction Dw is maintained to be the first interval W1, when the sheet S is discharged from the processing tray 1 onto the main tray T1, the sheet S may contacts with the pair of main tray cursors 7 so that the discharge of the sheet S may be disturbed.

Figure 14:
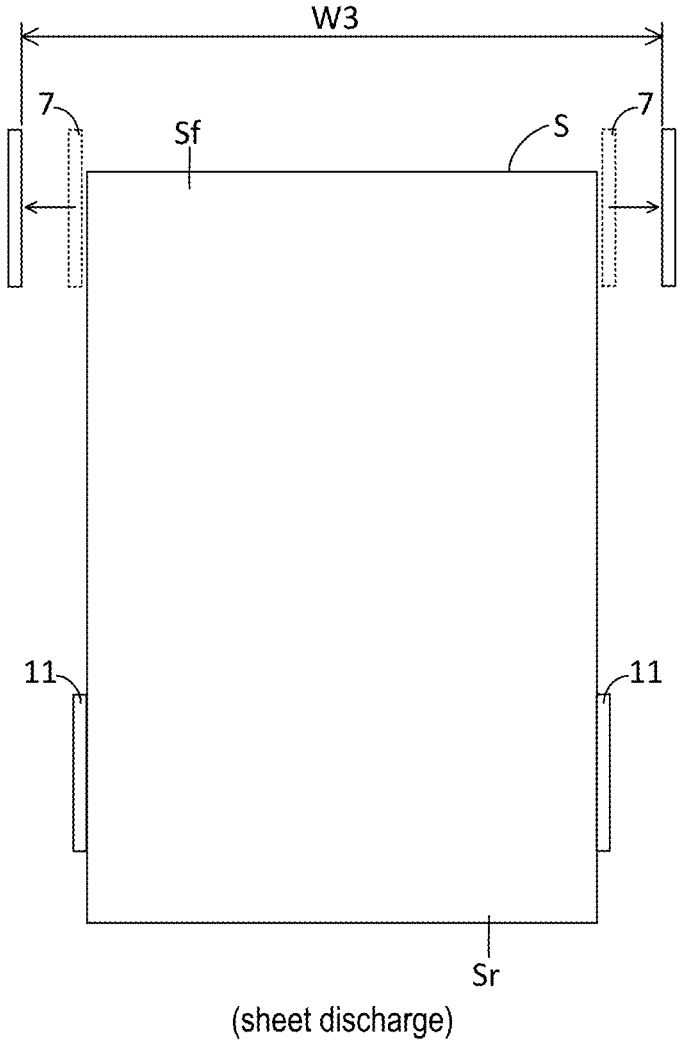
FIG. 14 is a schematic diagram illustrating a condition where the sheet is discharged from the processing tray of the sheet post-processing device according to one embodiment.

Therefore, when the sheet S is discharged from the processing tray 1 onto the main tray T1, the control unit 10 maintains the interval between the pair of main tray cursors 7 in the width direction Dw to be a third interval W3, which is larger than the first interval W1, as illustrated in FIG. 14. In other words, the control unit 10 increases the interval between the pair of main tray cursors 7 in the width direction Dw from that when performing the front end alignment process. The control unit 10 maintains the interval between the pair of main tray cursors 7 to be the third interval W3, and in this state it discharges the sheet S from the processing tray 1 onto the main tray T1. In this way, it is possible to prevent that the pair of main tray cursors 7 contact with the sheet S so that discharge of the sheet S is disturbed. The third interval W3 may be the same as the initial interval W0, or may be larger than the initial interval W0.

Note that the sheet post-processing device 100 has a sorting discharge function. In the sorting discharge, for example, discharge positions of units of sheets are shifted from each other in the width direction Dw on the main tray T1. In other words, in the sorting discharge, the sheets S on the processing tray 1 are shifted in the width direction Dw and then are discharged onto the main tray T1.

Figure 15:
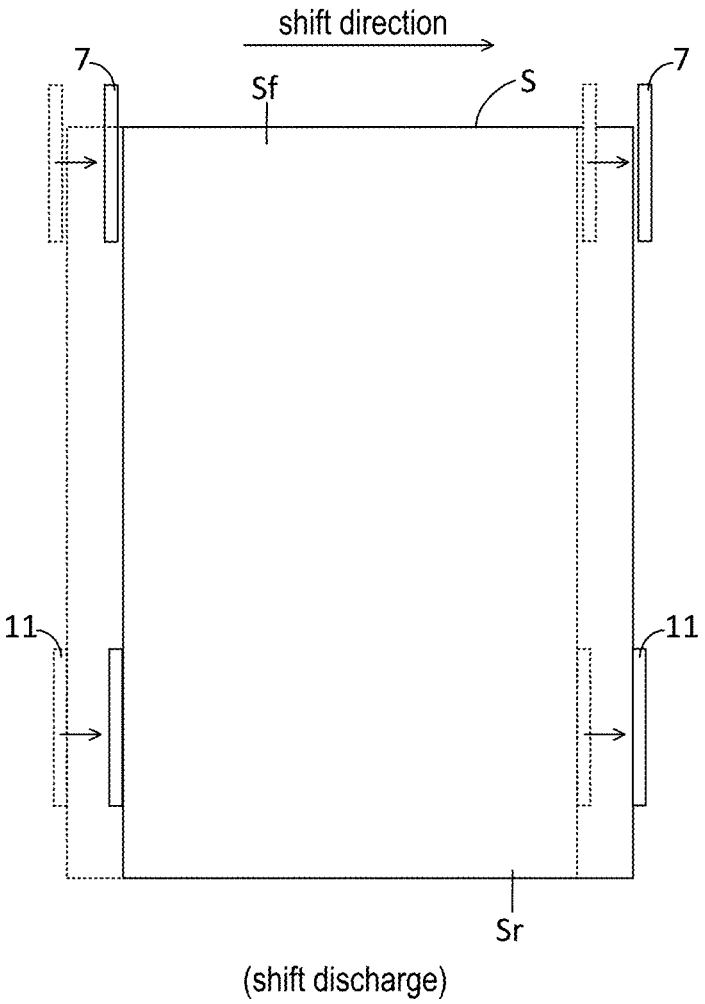
FIG. 15 is a schematic diagram for illustrating shift discharge that is performed by the sheet post-processing device according to one embodiment.

When the sheets S on the processing tray 1 are shifted in the width direction Dw and then are discharged onto the main tray T1, as illustrated in FIG. 15, the control unit 10 moves the pair of processing tray cursors 11 in the shift direction of the sheets S, and moves the pair of main tray cursors 7 in the shift direction in synchronization with the movement of the pair of processing tray cursors 11 in the shift direction. In this way, in the sorting discharge, it is possible to prevent that the pair of main tray cursors 7 contact with the sheet S so that discharge of the sheet S is disturbed.

Note that depending on the size of the sheet S, when the sheet S is loaded onto the processing tray 1, the sheet S loaded on the processing tray 1 may protrude only a little from the main discharge outlet 100B. Therefore, as a variation, if the sheet S loaded on the processing tray 1 protrudes only a little from the main discharge outlet 100B, the front end alignment process may not be performed when the sheet S is loaded onto the processing tray 1.

The embodiment disclosed in this specification is an example in every aspect and should not be interpreted as a limitation. The scope of the present disclosure is defined not by the above description of the embodiment but by the claims, and should be understood to include all modifications within meaning and scope equivalent to the claims.

What is claimed is:

1. A sheet post-processing device comprising:

a processing tray on which a sheet is loaded;

a post-processing section that performs predetermined post-processing on the sheet;

a discharge outlet through which the sheet on the processing tray is discharged;

a discharge tray on which the sheet discharged through the discharge outlet is loaded;

a discharging member that conveys the sheet on the processing tray toward the discharge outlet and discharges the sheet onto the discharge tray through the discharge outlet;

a pair of processing tray cursors that are movable above the processing tray in a reciprocation manner in a width direction perpendicular to a sheet conveying direction, and sandwich the sheet in the width direction so as to align the sheet;

a pair of discharge tray cursors that are movable above the discharge tray in a reciprocation manner in the width direction, and sandwich the sheet in the width direction so as to align the sheet; and a control unit, wherein when performing an alignment process on the sheet loaded on the processing tray, in a state where a front end of the sheet is protruded from the discharge outlet above the discharge tray, the control unit performs a front end alignment process in which the pair of discharge tray cursors sandwich the front end of the sheet protruded above the discharge tray in the width direction, and a rear end alignment process in which the pair of processing tray cursors sandwich a rear end of the sheet on the processing tray in the width direction, an interval between the pair of discharge tray cursors in the width direction when performing the front end alignment process is larger than an interval between the pair of processing tray cursors in the width direction when performing the rear end alignment process, and the control unit performs the rear end alignment process after performing the front end alignment process.

2. The sheet post-processing device according to claim 1, wherein the control unit performs the front end alignment process and the rear end alignment process every time when one sheet is loaded onto the processing tray.

3. The sheet post-processing device according to claim 1, wherein when performing the front end alignment process and the rear end alignment process on second and subsequent sheets, after performing the front end alignment process and the rear end alignment process on one sheet, the control unit sets an interval between the pair of discharge tray cursors in the width direction to be larger than that when performing the front end alignment process, and sets an interval between the pair of processing tray cursors in the width direction to be larger than that when performing the rear end alignment process.

4. The sheet post-processing device according to claim 1, wherein when the sheet is discharged onto the discharge tray, the control unit sets an interval between the pair of discharge tray cursors in the width direction to be larger than that when performing the front end alignment process.

5. The sheet post-processing device according to claim 1, wherein when performing shift discharge to shift the sheet on the processing tray in the width direction before discharging the sheet onto the discharge tray, the control unit moves the pair of processing tray cursors in a shift direction of the sheet, and moves the pair of discharge tray cursors in the shift direction in synchronization with the movement of the pair of processing tray cursors.

6. The sheet post-processing device according to claim 1, wherein the pair of discharge tray cursors is disposed in a movable manner in the width direction and in an up and down direction, when aligning the sheet on the discharge tray, the control unit sets the pair of discharge tray cursors at a first position to face side edges of the sheet loaded on the discharge tray, and when aligning the sheet on the processing tray, the control unit sets the pair of discharge tray cursors at a second position to face side edges of the front end of the sheet loaded on the processing tray, at a position higher than the first position.

7. An image forming system comprising:

the sheet post-processing device according to claim 1, and an image forming apparatus configured to form an image on the sheet, wherein the sheet post-processing device performs predetermined post-processing on the sheet after image formation.

8. The image forming system according to claim 7, wherein the image forming apparatus is an inkjet recording apparatus configured to eject ink onto the sheet so as to form an image.

* * * * *